US009095990B2

(12) United States Patent
Gosling et al.

(10) Patent No.: US 9,095,990 B2
(45) Date of Patent: Aug. 4, 2015

(54) METHOD FOR WRAPPING A NON-POROUS SUBSTRATE OBJECT WITH A WOOD VENEER

(75) Inventors: Geoff Gosling, Calgary (CA); Mogens Smed, Dewinton (CA)

(73) Assignee: DIRTT ENVIRONMENTAL SOLUTIONS LTD., Calgary, Alberta (CA)

( * ) Notice: Subject to any disclaimer, the term of this patent is extended or adjusted under 35 U.S.C. 154(b) by 1120 days.

(21) Appl. No.: 11/338,897

(22) Filed: Jan. 25, 2006

(65) Prior Publication Data

US 2006/0180268 A1 Aug. 17, 2006

Related U.S. Application Data

(60) Provisional application No. 60/646,547, filed on Jan. 25, 2005.

(51) Int. Cl.
*B27D 1/00* (2006.01)

(52) U.S. Cl.
CPC ..... *B27D 1/00* (2013.01); *Y10T 156/1028* (2015.01)

(58) Field of Classification Search
CPC ..... B29C 51/16; B29C 51/10; B29C 65/02; B29C 63/0017; B29C 63/0073; B29C 63/22; B29C 63/38; B29C 63/44; B29C 63/40; B29C 63/433; B29K 2311/14
USPC ..... 156/184–187, 189, 195, 196, 202, 203, 156/215, 218, 199–201, 212–214; 228/129; 264/285, 339
See application file for complete search history.

(56) References Cited

U.S. PATENT DOCUMENTS

| | | | | |
|---|---|---|---|---|
| 2,246,057 | A * | 6/1941 | Michaelis | 297/287 |
| 3,541,592 | A * | 11/1970 | Lewis | 144/348 |
| 5,453,142 | A * | 9/1995 | Klein | 156/201 |
| 6,015,475 | A * | 1/2000 | Hsieh et al. | 156/331.4 |
| 2004/0084138 | A1 * | 5/2004 | Henke et al. | 156/272.2 |

FOREIGN PATENT DOCUMENTS

WO WO 2004/078867 A2 * 9/2004

* cited by examiner

*Primary Examiner* — Christopher Schatz
(74) *Attorney, Agent, or Firm* — Welsh Flaxman & Gitler LLC

(57) ABSTRACT

There is described a method for at least partially covering selected surfaces of a non-porous substrate with a flexible veneer, the method comprising the steps of maintaining a humid environment during the covering of said substrate with the veneer, applying a preheated adhesive to one or both of the substrate and the veneer, progressively shaping the veneer to the selected surfaces of the substrate through the application of pressure biasing the veneer against the selected surfaces and curing the assembly of the veneer and the substrate.

29 Claims, 1 Drawing Sheet

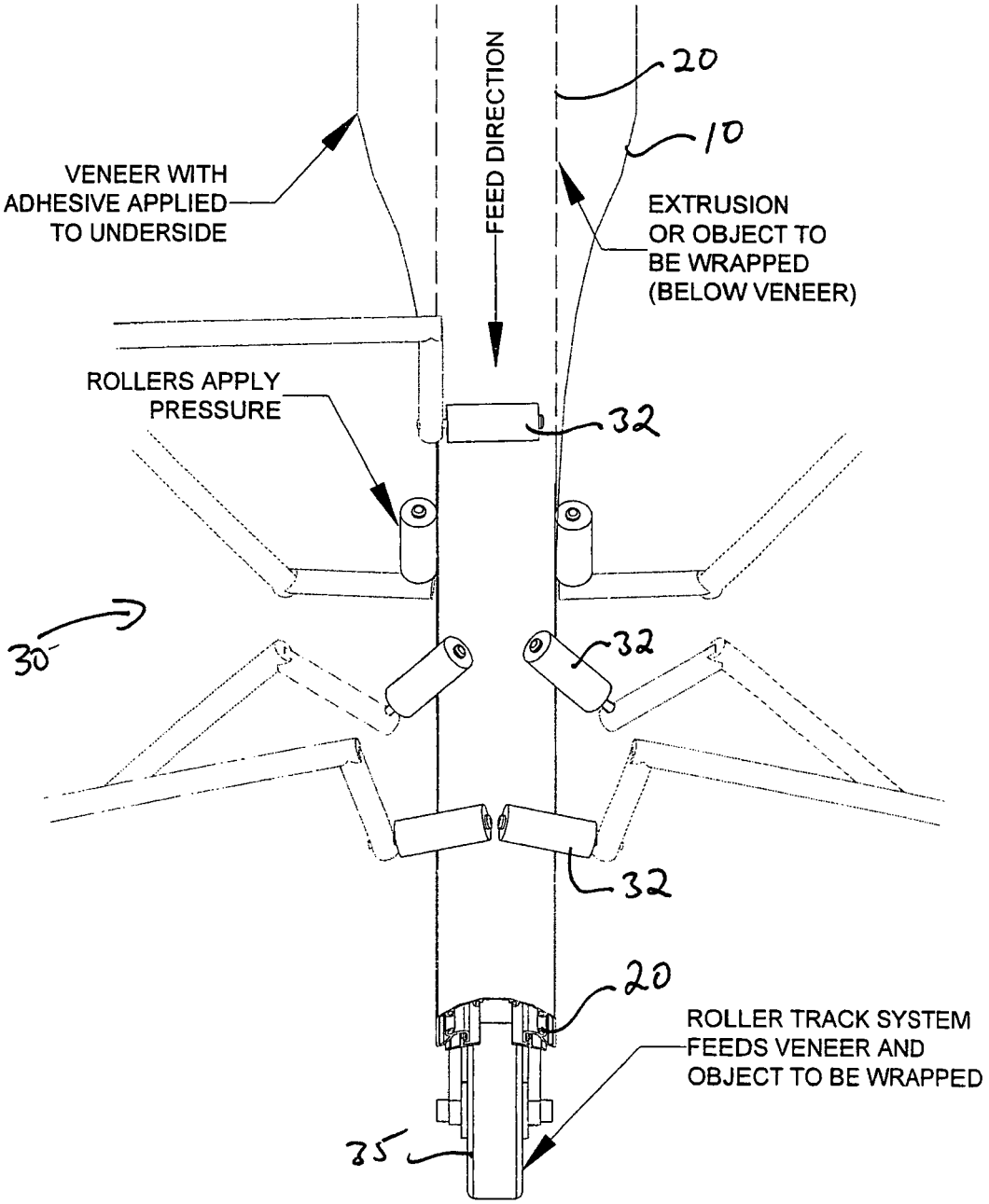
FEED DIRECTION
20
10
VENEER WITH
ADHESIVE APPLIED
TO UNDERSIDE
EXTRUSION
OR OBJECT TO
BE WRAPPED
(BELOW VENEER)
ROLLERS APPLY
PRESSURE
32
30
32
32
20
ROLLER TRACK SYSTEM
FEEDS VENEER AND
OBJECT TO BE WRAPPED
35

METHOD FOR WRAPPING A NON-POROUS SUBSTRATE OBJECT WITH A WOOD VENEER

CROSS-REFERENCE TO RELATED APPLICATIONS

The present invention claims the benefit of the filing date of U.S. Provisional Patent Application Ser. No. 60/646,547, entitled "WOOD VENEER WRAPPING OF NON-POROUS SUBSTRATE OBJECTS", filed Jan. 21, 2005.

FIELD OF THE APPLICATION

This invention relates to improvements in applying a finishing veneer to non-porous substrate objects.

BACKGROUND OF THE INVENTION

Finishing veneers, usually wood, are bonded to non-porous objects such as complex aluminum extrusions so that the objects will appear to be made of wood rather than the actual object material. Conventional methods of permanently bonding a wood veneer to a substrate require either a substrate made of a porous material or a veneer with a backing material that facilitates substrate bonding and bending. With conventional bonding processes, there is also the possibility that the veneer itself will be damaged in the bonding process.

SUMMARY OF THE INVENTION

It is an object of the present application to provide a method for bonding a veneer, which will typically be wood, to a substrate where the substrate is made of a non-porous material and the veneer does not have a special backing to facilitate bonding; in other words, the veneer is raw.

The method of the present invention overcomes the difficulties associated with bonding wood veneer to a non-porous substrate. The method of the present invention provides a unique series of related processes which permanently bond a wood veneer to a non-porous object without damaging the veneer.

According to the present invention then, there is provided a method for at least partially covering selected surfaces of a non-porous substrate with a flexible veneer, the method comprising the steps of maintaining a humid environment during the covering of said substrate with said veneer; applying a preheated adhesive to one or both of said substrate and said veneer; progressively shaping said veneer to said selected surfaces of said substrate through the application of pressure biasing said veneer against said selected surfaces; and curing the assembly of said veneer and said substrate.

BRIEF DESCRIPTION OF THE DRAWINGS

Preferred aspects of the invention will now be described in greater detail, and will be better understood when read in conjunction with the following drawing:

FIG. 1 is a schematical representation of a method of applying a veneer to a non-porous substrate.

DETAILED DESCRIPTION OF THE PREFERRED EMBODIMENT

Reference will now be made in detail to the method of the present invention. Further objects and improvements incorporated in the method will be apparent from the following specification.

The method of the present invention is a method for wrapping a non-porous substrate object with a wood veneer strip. For purposes of illustration only, the non-porous substrate is described as being an aluminum extrusion. It may however be any other non-porous material and/or object to which a veneer is advantageously applied. By non-porous is meant that the substrate lacks sufficient porosity for significant permeation by fluids and gases.

The method is preferably conducted in a humid environment, to maintain the natural properties of the wood veneer and to keep the veneer as flexible as possible. It may be necessary to spray the surface of the veneer with a light $H_2O$ mist to preserve the integrity of the veneer. Preferably, relative humidity is maintained in the range of approximately 40% for ambient temperatures in the range of 20° Celsius. It will be understood that humidity levels may vary considerably depending upon the type of veneer being used and its characteristics and qualities.

The method consists of series of steps. First, the veneer 10 may have to be pre-sanded to a specific thickness to allow it to conform to the radii of the aluminum substrate 20 without the use of a backing material. The necessary thickness of the veneer is dependant on the radii of the substrate object. The thickness of the veneer prior to sanding will normally be in the range of 0.6 mm, and post-sanding, will be in the range of 0.3 mm to 0.4 mm. It will be understood however that these ranges are not intended to be limiting, and may vary depending upon the variety of raw veneer, its properties and characteristics and the radii in question. As well, the sanding may be localized to those portions of the veneer that will be bent or curved around the substrate's radii.

Next, a liquid adhesive is preheated to a temperature in the range of 110° to 130° Celsius. The liquid adhesive is preferably a fast hardening, permanent adhesive such as a polyurethane reactive (PUR) adhesive. The actual temperature needed is dependant on the ambient temperature and humidity of the manufacturing environment. On any given day, test runs must be performed to determine the exact temperature to which the adhesive must be heated. For example, in one test performed by the applicant, for an ambient temperature of 20° Celsius and a relative humidity of 40%, the adhesive was heated to a temperature of 120° Celsius.

The heated adhesive is applied to the underside of veneer 10 such as by means of spraying, brushing, dipping or by any other suitable means. The adhesive may also be applied to the substrate in addition or in the alternative to the veneer.

The substrate itself can be preheated prior to the application of the veneer to the substrate. The substrate is preferably preheated to a temperature in the range of 30 degree to 40 degree Celsius prior to being covered by the veneer. This range may vary up or down and is not intended to be limitative.

Next, one end of veneer strip 10 is applied to the non-porous substrate 20 and pressure is immediately applied to the veneer against the substrate using for example a veneer wrapping machine 30. The instant adhesion of veneer to substrate allows the veneer to bend around substrate objects with tight radii. The pressure is preferably applied by a pressure process using a series of staged rollers 32. Other means of applying pressure, such as pads or brushes, may be used but rollers have been found less likely to cause abrasion, marking or other damage to the veneer's surface.

Rollers 32 are used to progressively wrap wood veneer strip 10 around extrusion 20. Veneer wrapping machine 30 consists of a roller feeder 35 to feed the veneer and substrate through and past the plurality of rollers 32 positioned specifically to apply pressure to all surfaces of the substrate. The pressure applied to the substrate must be adjusted and tested for every substrate to be wrapped and will therefore be determined empirically.

After the substrate has been wrapped with the wood veneer, the assembly of substrate and wood veneer is preferably cured by microwave flash-off and ultraviolet (UV) curing. This curing process avoids having to reheat the assembly, which could compromise the bonding of the veneer to the substrate object. Certain substrates will actually cool during the microwave flash-off process. Heat curing may be possible in some instances but experience and testing will determine if and when this will be effective.

If a finish is to be applied to the veneer following the curing process, the finish should be water-based. Non water-based finishes contain solvents which might compromise the bonding properties of the adhesive.

The above-described embodiments of the present invention are meant to be illustrative of preferred embodiments and are not intended to limit the scope of the present invention. Various modifications, which would be readily apparent to one skilled in the art, are intended to be within the scope of the present invention. The only limitations to the scope of the present invention are set forth in the following claims appended hereto.

What is claimed is:

1. A method for at least partially covering selected surfaces of a non-porous substrate with a flexible wood veneer, the method comprising the steps of:

maintaining a humid environment, a relative humidity is maintained at approximately 40% for ambient temperatures in a selected temperature range during the covering of said substrate with said veneer so that the veneer in the environment is exposed to the humidity for flexibility of the veneer;

applying an adhesive to one or both of said substrate and said veneer, said adhesive being preheated to a temperature selected on the basis of the temperature and the relative humidity in the environment;

progressively shaping said veneer to said selected surfaces of said substrate through the application of pressure biasing said veneer against said selected surfaces; and curing the assembly of said veneer and said substrate.

2. The method of claim 1 wherein said adhesive is preheated to a temperature in the range of about 110° to about 130° Celsius.

3. The method of claim 1 wherein said pressure biasing said veneer against said substrate is applied by a plurality of pressure application means.

4. The method of claim 3 wherein said pressure application means comprise rollers arranged to sequentially bias said veneer against said selected surfaces of said substrate to complete the covering thereof.

5. The method of claim 4 wherein said veneer and said substrate are moved continuously past said rollers for the covering of a predetermined length of said substrate.

6. The method of claim 2, wherein said substrate is preheated to be at a temperature in the range of about 30° to 40° Celsius prior to being covered by the veneer.

7. The method of claim 6 wherein the step of maintaining a humid environment includes wetting an outer surface of said veneer with a mist of water.

8. The method of claim 2 wherein said adhesive is a fast hardening, permanent adhesive.

9. The method of claim 8 wherein said adhesive is a polyurethane reactive adhesive.

10. The method of claim 1 wherein said curing is at least partially performed by means of microwave flash-off.

11. The method of claim 10 wherein said curing is by means of ultraviolet curing.

12. The method of claim 1 wherein said humid environment is maintained for an ambient temperature of about 20° Centigrade.

13. The method of claim 1 wherein said substrate is an aluminum extrusion.

14. The method of claim 13 wherein said veneer is a raw wood veneer without a backing material on a surface of said veneer that is adhered to said substrate.

15. A method for at least partially covering selected surfaces of a non-porous substrate with a flexible wood veneer, the method comprising the steps of:

maintaining a humid environment at about 40% relative humidity for a temperature of about 20° Centigrade by wetting an outer surface of said veneer with a mist of water during the covering of said substrate with said veneer so that the veneer in the environment is exposed to the humidity for flexibility of the veneer;

applying an adhesive to one or both of said substrate and said veneer, said adhesive being preheated to a temperature selected on the basis of the temperature and the relative humidity in the environment;

progressively shaping said veneer to said selected surfaces of said substrate through the application of pressure biasing said veneer against said selected surfaces; and curing the assembly of said veneer and said substrate.

16. The method of claim 15 wherein said adhesive is preheated to a temperature in the range of about 110° to about 130° Celsius.

17. The method of claim 15 wherein said veneer or selected portions thereof are reduced in thickness to facilitate the shaping thereof about said substrate.

18. The method of claim 15 wherein said pressure biasing said veneer against said substrate is applied by a plurality of pressure application means.

19. The method of claim 18 wherein said pressure application means comprise rollers arranged to sequentially bias said veneer against said selected surfaces of said substrate to complete the covering thereof.

20. The method of claim 16, wherein said substrate is preheated to be at a temperature in the range of about 30° to 40° Celsius prior to being covered by the veneer.

21. The method of claim 16 wherein said adhesive is a fast hardening, permanent adhesive.

22. The method of claim 21 wherein said adhesive is a polyurethane reactive adhesive.

23. The method of claim 15 wherein said curing is at least partially performed by means of microwave flash-off.

24. The method of claim 23 wherein said curing is by means of ultraviolet curing.

25. The method of claim 1 wherein said substrate is an aluminum extrusion.

26. The method of claim 25 wherein said is a raw wood veneer without a backing material on a surface of said veneer that is adhered to said substrate.

27. A method for at least partially covering selected surfaces of a non-porous substrate with a flexible wood veneer, the method comprising the steps of:

maintaining a humid environment at about 40% relative humidity within a selected relative humidity range and a selected temperature range during the covering of said substrate with said veneer so that the veneer in the environment absorbs at least some of the humidity for flexibility of the veneer;

applying an adhesive to one or both of said substrate and said veneer, said adhesive being preheated to a temperature selected on the basis of the temperature and the relative humidity in the environment;

progressively shaping said veneer to said selected surfaces of said substrate through the application of pressure biasing said veneer against said selected surfaces; and curing the assembly of said veneer and said substrate.

28. The method of claim 27, wherein said adhesive is preheated to a temperature in the range of about 110° to about 130° Celsius.

29. The method of claim 28, wherein said substrate is preheated to a temperature in the range of about 30° to 40° Celsius prior to being covered by the veneer.

* * * * *